US009914604B2

(12) United States Patent
Fujiwara et al.

(10) Patent No.: US 9,914,604 B2
(45) Date of Patent: Mar. 13, 2018

(54) SHEET FEEDER DEVICE AND IMAGE FORMING APPARATUS

(71) Applicant: Konica Minolta, Inc., Tokyo (JP)

(72) Inventors: Takashi Fujiwara, Hachioji (JP); Jun Onishi, Hino (JP); Masahito Takano, Koganei (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/334,960

(22) Filed: Oct. 26, 2016

(65) Prior Publication Data

US 2017/0129724 A1 May 11, 2017

(30) Foreign Application Priority Data

Nov. 11, 2015 (JP) ..... 2015-220830

(51) Int. Cl.
*B65H 3/02* (2006.01)
*B65H 3/12* (2006.01)
(Continued)

(52) U.S. Cl.
CPC ..... *B65H 3/02* (2013.01); *B65H 1/04* (2013.01); *B65H 3/047* (2013.01); *B65H 3/126* (2013.01); *B65H 3/128* (2013.01); *B65H 3/48* (2013.01); *B65H 3/56* (2013.01); *B65H 3/60* (2013.01); *G03G 15/6511* (2013.01); *G03G 15/6529* (2013.01); *B65H 2403/512* (2013.01);
(Continued)

(58) Field of Classification Search
CPC . B65H 3/02; B65H 3/56; B65H 3/128; B65H 3/60; B65H 3/48; B65H 2405/1134; B65H 3/24; B65H 3/34; B65H 3/54; B65H 3/62; B65H 2405/214; B65H 31/34; B65H 31/38; B65H 2301/4234
USPC ..... 271/105
See application file for complete search history.

(56) References Cited

U.S. PATENT DOCUMENTS 3,981,494 A * 9/1976 Prestegaard ..... B65H 3/063 271/10.01
6,315,286 B1 * 11/2001 Muenchinger ..... B65H 1/025 271/146
(Continued)

FOREIGN PATENT DOCUMENTS

JP 57-093840 A 6/1928
JP 10-218392 A 8/1998
(Continued)

OTHER PUBLICATIONS

Japanese Office Action and english translation, 2015-220830, dated Oct. 6, 2017.

*Primary Examiner* — Jeremy R Severson
(74) *Attorney, Agent, or Firm* — Lucas & Mercanti, LLP

(57) ABSTRACT

A sheet feeder device includes: a sheet feed tray configured to store a sheet stack formed with a plurality of paper sheets; an elastic member capable of expanding and contracting; a contact mechanism configured to bring the elastic member into contact with an edge of the sheet stack; an expansion mechanism configured to expand the elastic member in a direction of stacking of the paper sheets; and a control unit configured to cause the expansion mechanism to expand the elastic member while the elastic member is kept in contact with the edge of the sheet stack by the contact mechanism.

13 Claims, 9 Drawing Sheets

(51) Int. Cl.

| | |
|---|---|
| ***B65H 1/04*** | (2006.01) |
| ***B65H 3/04*** | (2006.01) |
| ***B65H 3/48*** | (2006.01) |
| ***G03G 15/00*** | (2006.01) |
| ***B65H 3/56*** | (2006.01) |
| ***B65H 3/60*** | (2006.01) |

(52) U.S. Cl.
CPC ..... *B65H 2404/52131* (2013.01); *B65H 2404/563* (2013.01); *B65H 2405/1134* (2013.01)

(56) References Cited

U.S. PATENT DOCUMENTS

| | | | | |
|---|---|---|---|---|
| 6,416,048 | B2 * | 7/2002 | Tomiyama | B65H 3/124 271/107 |
| 8,226,082 | B2 * | 7/2012 | Seiler | B65H 1/02 271/146 |
| 8,256,761 | B1 * | 9/2012 | Klein | B65H 3/56 271/121 |

FOREIGN PATENT DOCUMENTS

| | | | |
|---|---|---|---|
| JP | 2006-143468 | A | 6/2006 |
| JP | 2012150217 | A | 8/2012 |

* cited by examiner

SHEET FEEDER DEVICE AND IMAGE FORMING APPARATUS

The entire disclosure of Japanese Patent Application No. 2015-220830 filed on Nov. 11, 2015 including description, claims, drawings, and abstract are incorporated herein by reference in its entirety.

BACKGROUND OF THE INVENTION

Field of the Invention

The present invention relates to a sheet feeder device and an image forming apparatus.

Description of the Related Art

A commercial image forming apparatus such as a production printer is normally expected to cope with various kinds of paper sheets, and there is a demand for image forming apparatuses that are not easily affected by environmental disturbances such as humidity, regardless of thicknesses and types of paper sheets. Particularly, coated paper has a low air permeability and a high moisture absorption rate. Therefore, the sticking force between paper sheets is strong in a high-humidity environment, and multiple feeding or non-feeding often occurs in a sheet feed process.

In a conventional sheet feeder device, to quickly dehumidify the inside of the sheet feed tray, dehumidified/dried air is stored in a storage tank in advance. Immediately after the sheet feed tray is set in the housing, or when a command signal for a start of a sheet feeding operation is received from a control unit, an air blow mechanism blows the dehumidified/dried air from the storage tank into the housing (see JP 2012-150217 A).

However, in the sheet feed tray having paper sheets stacked therein, the sticking force between paper sheets is stronger at lower portions of the sheet stack due to the weight of the paper sheets, and air does not easily enter the sheet stack. As a result, the dryness factor of paper sheets differs between an upper portion and a lower portion of the sheet stack in the sheet feed tray.

FIG. 13 shows changes in weight observed in a case where the temperature and humidity environments for coated paper sheets were changed. The first sheet and the third sheet from the top of a sheet stack, and the sheet in the middle position of the sheet stack (approximately the 250th sheet) were subjected to measurement. First, in the "initial stage", the weights of the paper sheets were measured in a normal environment. The weights of the paper sheets measured after "moisture absorption" are the results of measurement carried out after the paper sheets were left in an 80% RH environment at 30 degrees centigrade for about 20 hours. The weights of the paper sheets measured "after about 5 minutes" are the results of measurement carried out after the paper sheets having absorbed moisture were moved to a 50% RH environment at 20 degrees centigrade, and were left there for about five minutes.

FIG. 14 shows the rates of change in the weights of the "1st sheet", the "3rd sheet", and the "middle sheet" of FIG. 13 between "after moisture absorption" and "after about 5 minutes". The "middle sheet" in the middle position of the sheet stack has a lower rate of change in the weight of paper and a lower dehumidification rate (dryness factor) than the "1st sheet" and the "3rd sheet", which are closer to the upper surface of the sheet stack. In this manner, it was confirmed that there was a difference in dehumidification performance between an upper portion and the middle position of the sheet stack. Therefore, when a paper sheet in the middle position is separated from the other paper sheets while the sticking force between the paper sheets having absorbed moisture is still strong, multiple feeding or non-feeding easily occurs.

SUMMARY OF THE INVENTION

The present invention has been made in view of the above described problems in conventional technologies, and an object thereof is to reduce the influence of environmental disturbances, and prevent multiple feeding and non-feeding.

To achieve the abovementioned object, according to an aspect, a sheet feeder device reflecting one aspect of the present invention comprises: a sheet feed tray configured to store a sheet stack formed with a plurality of paper sheets; an elastic member capable of expanding and contracting; a contact mechanism configured to bring the elastic member into contact with an edge of the sheet stack; an expansion mechanism configured to expand the elastic member in a direction of stacking of the paper sheets; and a control unit configured to cause the expansion mechanism to expand the elastic member while the elastic member is kept in contact with the edge of the sheet stack by the contact mechanism.

According to an invention of Item. 2, in the sheet feeder device of Item. 1, the sheet feeder device preferably further comprises a suction conveyance unit configured to suck and convey the uppermost paper sheet of the sheet stack.

According to an invention of Item. 3, in the sheet feeder device of Item. 1 or 2, the sheet feeder device preferably further comprises an air blow mechanism configured to blow air against the sheet stack, wherein the control unit the sheet feeder device causes the air blow mechanism to blow air into a space at the edge of the sheet stack, while the elastic member is kept in contact with the edge of the sheet stack by the contact mechanism, and the elastic member remains expanded by the expansion mechanism.

According to an invention of Item. 4, in the sheet feeder device of Item. 2, the sheet feeder device preferably further comprises an air blow mechanism configured to blow air against the sheet stack, wherein before causing the suction conveyance unit to suck the uppermost paper sheet, the control unit preferably causes the contact mechanism to bring the elastic member into contact with the edge of the sheet stack, causes the expansion mechanism to expand the elastic member, and causes the air blow mechanism to blow air into a space at the edge of the sheet stack.

According to an invention of Item. 5, in the sheet feeder device of any one of Items. 1 to 4, the sheet feeder device preferably further comprises a curvature adding unit configured to bend the sheet stack and cause the sheet stack to protrude on the side of the uppermost paper sheet of the sheet stack while the elastic member is kept in contact with the edge of the sheet stack by the contact mechanism.

According to an invention of Item. 6, in the sheet feeder device of any one of Items. 1 to 5, the elastic member is preferably disposed in one of a position facing the top edge of the paper sheet in a direction of sheet conveyance in the sheet feed tray, and a corner position of the paper sheet.

According to an invention of Item. 7, in the sheet feeder device of any one of Items. 1 to 5, the elastic member is preferably one of a plurality of elastic members capable of expanding and contracting, and one of the elastic members is preferably disposed in a position on the opposite side of the sheet feed tray from another one of the elastic members.

According to an invention of Item. 8, in the sheet feeder device of any one of Items. 1 to 7, the elastic member is preferably formed with a plurality of materials having different degrees of expansion and contraction from one another.

According to an invention of Item. 9, in the sheet feeder device of any one of Items. 1 to 7, the surface of the elastic member to be brought into the edge of the sheet stack preferably has one of a corrugated form and a viscous element attached thereto.

According to an invention of Item. 10, in the sheet feeder device of any one of Items. 1 to 9, the elastic member is preferably formed with a rotatable endless belt.

According to an invention of Item. 11, in the sheet feeder device of any one of Items. 1 to 10, during a standby period before sheet feeding, the control unit preferably repeats a contact operation for the elastic member with the contact mechanism, and an expanding operation for the elastic member with the expansion mechanism.

To achieve the abovementioned object, according to an aspect, an image forming apparatus reflecting one aspect of the present invention comprises the sheet feeder device of any one of Items. 1 to 11.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

First, a first embodiment of an image forming apparatus according to the present invention will be described. However, the present invention is not limited to the illustrated examples.

Figure 1:
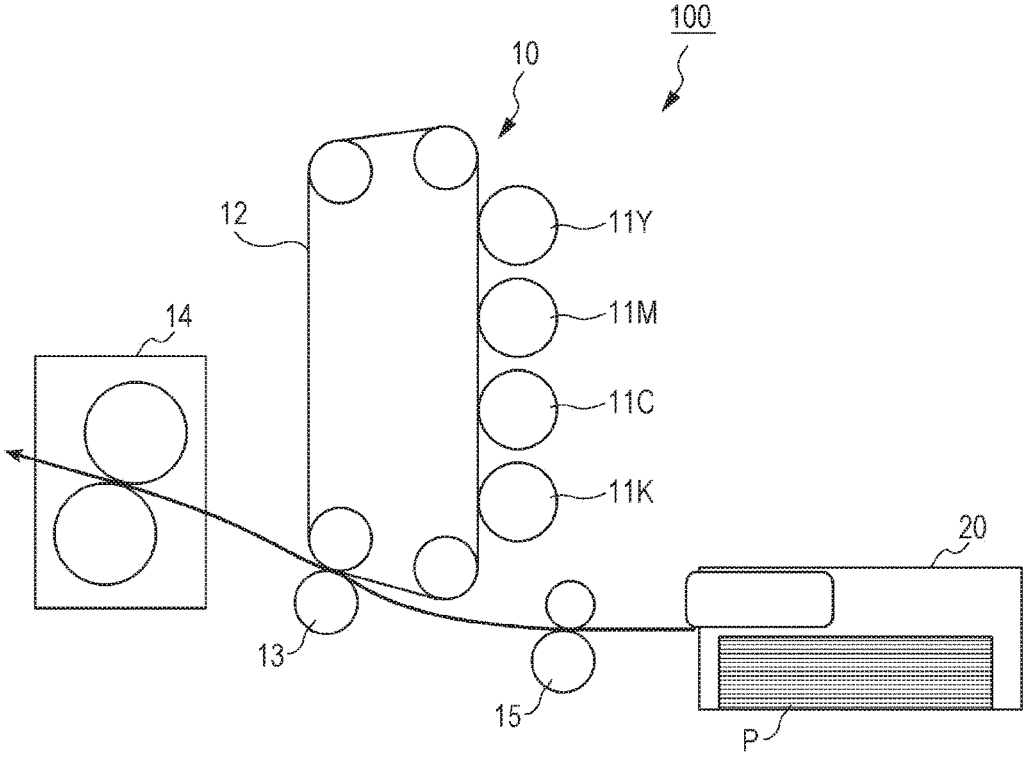
FIG. 1 is a schematic cross-sectional view of an image forming apparatus according to a first embodiment of the present invention.

FIG. 1 is a schematic cross-sectional view of an image forming apparatus 100 according to a first embodiment. The image forming apparatus 100 includes an image forming unit 10 and a sheet feeding unit 20. The image forming apparatus 100 forms an image on a paper sheet P in accordance with image data transmitted from an external device such as a computer connected to the image forming apparatus 100 directly or via a network.

The image forming unit 10 forms an image on a paper sheet P supplied from the sheet feeding unit 20. The image forming unit 10 includes photosensitive members 11Y, 11M, 11C, and 11K for the respective colors of yellow (Y), magenta (M), cyan (C), and black (K), an intermediate transfer belt 12, a secondary transfer roller 13, a fixing unit 14, and resist rollers 15.

After uniformly charged, the photosensitive members 11Y, 11M, 11C, and 11K are scanned and exposed by laser beams, and electrostatic latent images are formed in accordance with image data of the respective colors. Toners of the respective colors are then attached to the electrostatic latent images on the photosensitive members 11Y, 11M, 11C, and 11K, and thus, development is carried out.

The toner images formed in the respective colors on the photosensitive members 11Y, 11M, 11C, and 11K are sequentially transferred onto the intermediate transfer belt 12.

With the secondary transfer roller 13, the color toner image on the intermediate transfer belt 12 is transferred onto one surface of a paper sheet P supplied from the sheet feeding unit 20.

The fixing unit 14 heats and presses the toner image transferred onto the paper sheet P, to fix the toner image to the paper sheet P.

The resist rollers 15 adjust the timing to send the paper sheet P to the secondary transfer roller 13 by temporarily stopping the conveyance of the paper sheet P supplied from the sheet feeding unit 20, so that the image is appropriately positioned relative to the paper sheet P.

Figure 2A:
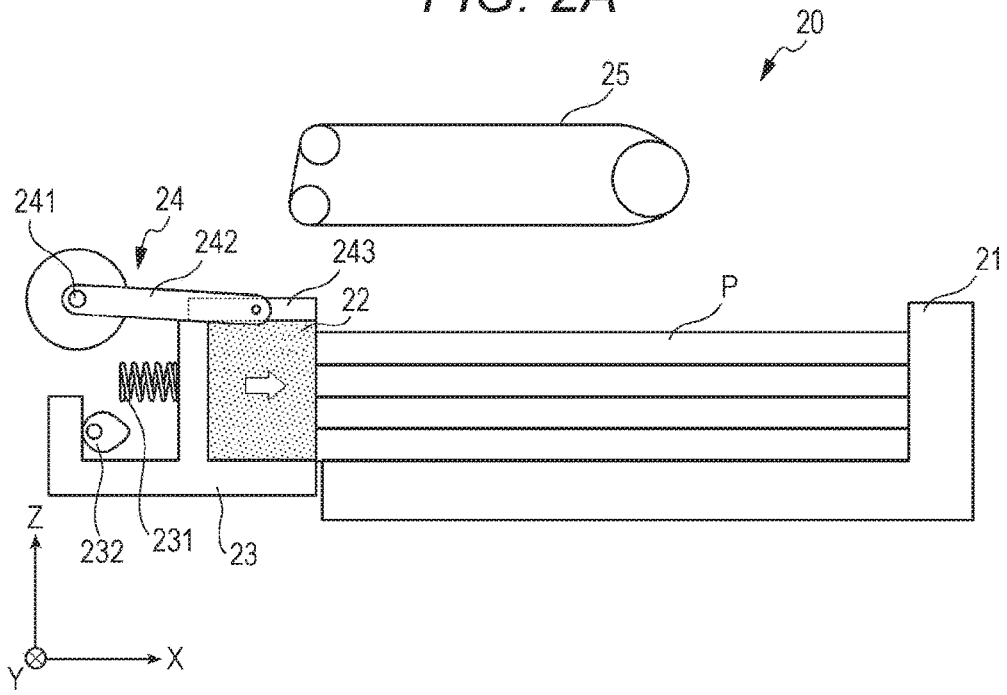
FIG. 2A is a schematic cross-sectional view of a sheet feeding unit.

FIG. 2A is a schematic cross-sectional view of the sheet feeding unit 20. The sheet feeding unit 20 includes a sheet feed tray 21, elastic members 22, a contact mechanism 23, an expansion mechanism 24, and a conveyance belt 25.

A stack of paper sheets P on which images are to be formed are stored in the sheet feed tray 21.

Each elastic member 22 is formed with an elastic material, such as sponge or rubber. Each elastic member 22 is disposed in a position in contact with the top edges of the paper sheets P in the direction of sheet conveyance in the sheet feed tray 21. That is, the top edges of the paper sheets P to be conveyed are located on the side of the elastic members 22.

Figure 3:
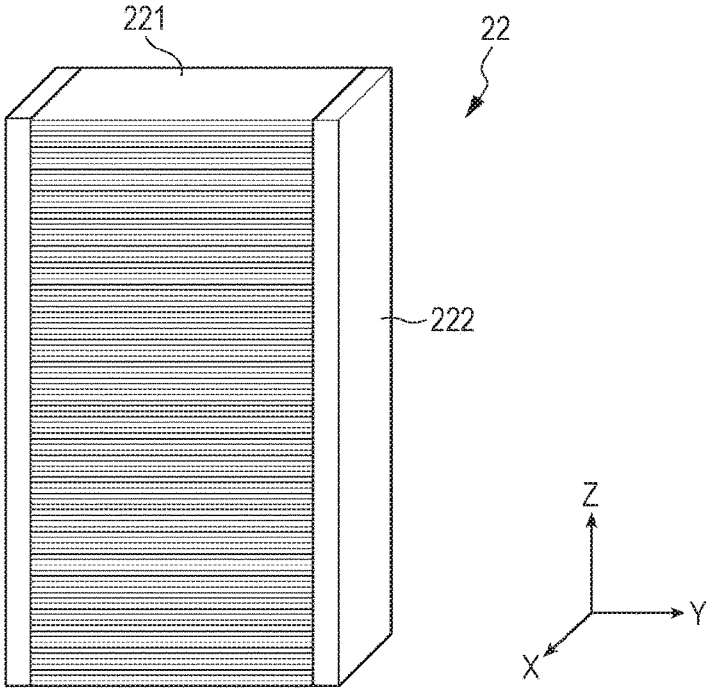
FIG. 3 is a perspective diagram showing the structure of an elastic member.

FIG. 3 shows the structure of each elastic member 22. Each elastic member 22 is formed with a rubber member 221 and rubber members 222. The rubber member 221 and the rubber members 222 are materials with different degrees of expansion and contraction.

The elastic members 22 preferably have anisotropic characteristics, such as being weak in the direction of contact with the paper sheets P (the X-direction shown in FIG. 3 and FIG. 2A) while being strong in the direction of expansion/contraction of the elastic members 22 (the Z-direction shown in FIG. 3 and FIG. 2A).

The rubber member 221 is formed with a stack of sheet-like soft rubber layers. The rubber members 222 are formed with relatively hard rubber members. In the sheet width direction (the Y-direction shown in FIG. 3 and FIG. 2A) perpendicular to the sheet conveyance direction, the rubber member 221 is interposed between the rubber members 222, and the edges of the respective layers in the rubber member 221 in the Y-direction are bonded to the rubber members 222. The respective layers in the rubber member 221 are not bonded to one another. When the elastic members 22 are brought into contact with the paper sheets P, the respective layers in the rubber member 221 catch the paper sheets P, so that spaces are easily formed between the paper sheets P.

The contact mechanism 23 brings the elastic members 22 into contact with the top edge of the sheet stack. The contact mechanism 23 includes a resilient member 231 and a cam member 232. The resilient member 231 pushes the contact mechanism 23 in the X-direction shown in FIG. 2A. As the cam member 232 rotates about a shaft, the position of the contact mechanism 23 in the X-direction changes, and the elastic members 22 are brought into contact with the top edge of the sheet stack or are moved away from the top edge. FIG. 2A shows a situation where the elastic members 22 are in contact with the top edge of the sheet stack.

The expansion mechanism 24 expands the elastic members 22 in the stacking direction of the paper sheets P (the Z-direction shown in FIG. 2A). The expansion mechanism 24 includes a support point 241, an arm 242, and a pull-up unit 243. The arm 242 can rotate about the support point 241. The pull-up unit 243 is connected to the end of the arm 242 on the opposite side from the support point 241.

The lower surface of each elastic member 22 is bonded to the contact mechanism 23, and the upper surface of each elastic member 22 is bonded to the lower surface of the pull-up unit 243. The arm 242 is made to rotate about the support point 241, to pull up the pull-up unit 243 in the Z-direction. In this manner, the elastic members 22 can be expanded.

Figure 2B:
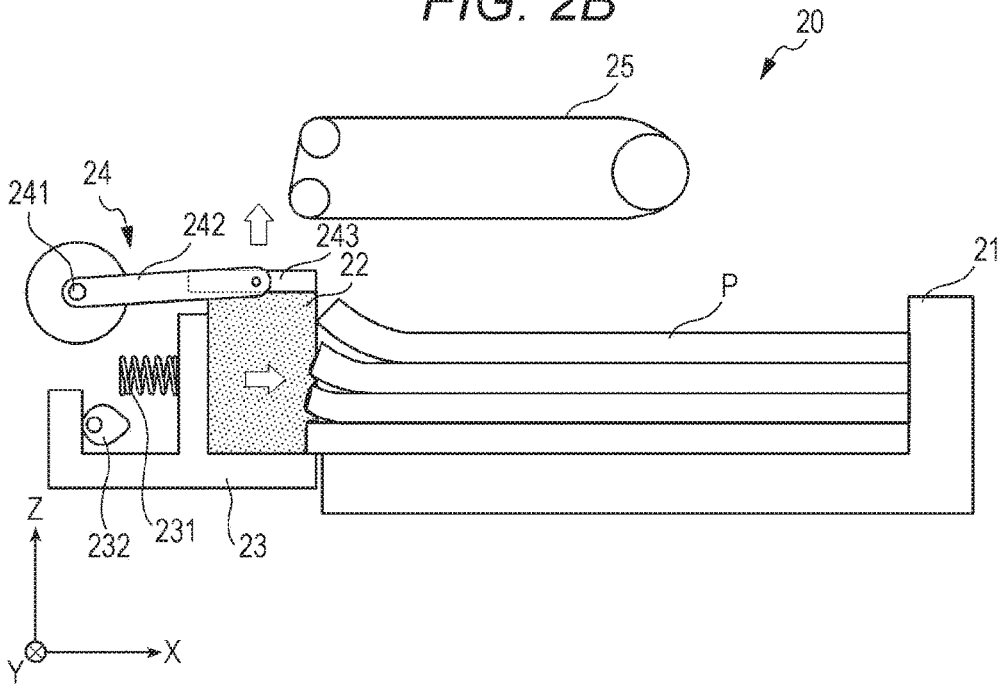
FIG. 2B is a diagram showing a situation where elastic members are expanded.

As shown in FIG. 2B, spaces are formed between the paper sheets P at the top edges, as the elastic members 22 are expanded by the expansion mechanism 24 while the elastic members 22 are kept in contact with the top edge of the sheet stack by the contact mechanism 23. These spaces are formed, because a force acting in the direction to separate the paper sheets from one another is generated by the friction between the top edges of the paper sheets and the elastic members 22, and by the expansion of the elastic members 22.

The conveyance belt 25 is a suction conveyance means that sucks the uppermost paper sheet P of the sheet stack stored in the sheet feed tray 21, and then conveys the paper sheet P. The conveyance belt 25 sends the uppermost paper sheet P of the sheet stack to the image forming unit 10. A large number of through holes with small diameters are formed in the conveyance belt 25, and a suction means provided on the inner side of the conveyance belt 25 sucks air through the conveyance belt 25, to attract the paper sheet P. The conveyance belt 25 is stretched around rollers. As the rollers rotate, the conveyance belt 25 rotates. As the conveyance belt 25 rotates, the paper sheet P sticking to the conveyance belt 25 is conveyed.

Figure 4:
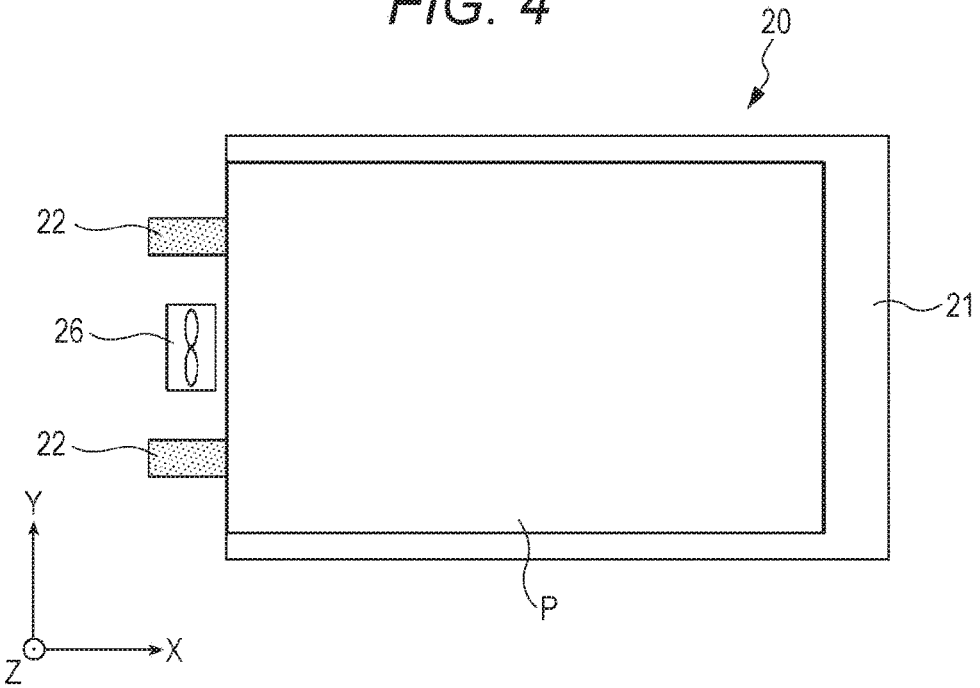
FIG. 4 is a plan view of the sheet feeding unit.

FIG. 4 is a plan view of the sheet feeding unit 20. The sheet feeding unit 20 includes an air blow mechanism 26.

The air blow mechanism 26 blows air against the sheet stack. The air blow mechanism 26 is disposed on the sheet top-edge side in the direction of sheet conveyance in the sheet feed tray 21, and is located between two elastic members 22.

Figure 5:
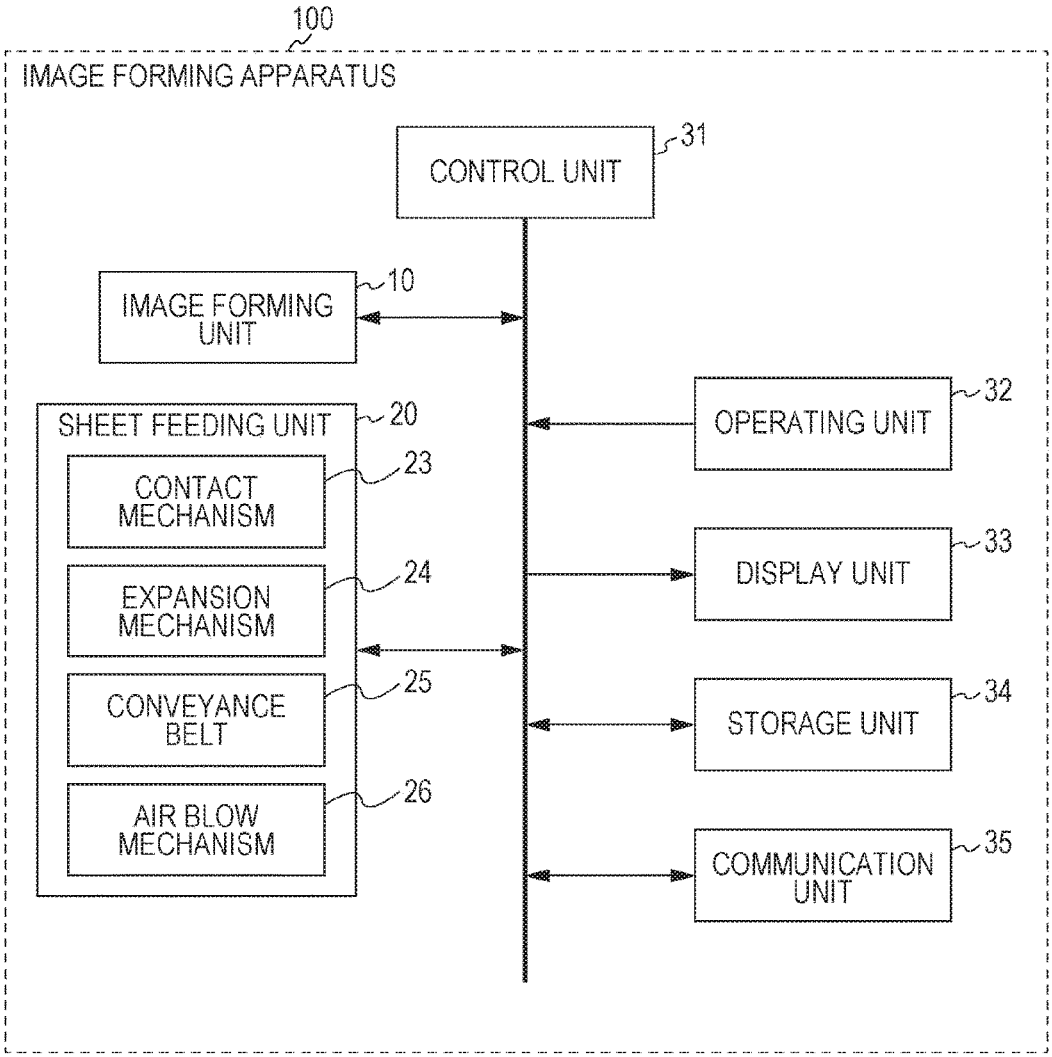
FIG. 5 is a block diagram showing the functional configuration of the image forming apparatus.

FIG. 5 shows the functional configuration of the image forming apparatus 100. The image forming apparatus 100 includes the image forming unit 10, the sheet feeding unit 20, a control unit 31, an operating unit 32, a display unit 33, a storage unit 34, and a communication unit 35. These components are connected to one another by a bus. Of these components, the functional units already explained above will not be described below.

The control unit 31 includes a central processing unit (CPU), a read only memory (ROM), and a random access memory (RAM), and collectively controls processing operations of the respective components of the image forming apparatus 100. The CPU reads various processing programs stored in the ROM, and loads the programs into the RAM. In accordance with the loaded programs, the CPU performs various kinds of processing.

The operating unit 32 includes a touch panel designed to cover the display screen of the display unit 33, and various operation keys such as numeric keys and a start key. The operating unit 32 outputs operation signals based on user operations to the control unit 31.

The display unit 33 is formed with a liquid crystal display (LCD), and displays various screens in accordance with instructions indicated by display signals input from the control unit 31.

The storage unit 34 is formed with a storage device, such as a nonvolatile semiconductor memory or a hard disk, and stores data related to various kinds of processing.

The communication unit 35 transfers data to and from an external device connected to a network, such as a local area network (LAN).

The control to be performed in a sheet feeding operation is now described.

First, the control unit 31 controls the contact mechanism 23 to bring the elastic members 22 into contact with the top edge of the sheet stack. During this process, the elastic members 22 remain compressed by the expansion mechanism 24 or are maintained at the natural length.

After that, the control unit 31 controls the expansion mechanism 24 to expand the elastic members 22 while the elastic members 22 are kept in contact with the top edge of the sheet stack by the contact mechanism 23. As a result, spaces are formed between the paper sheets P at the top edges. The control unit 31 and the sheet feeding unit 20 forma sheet feeder device according to an embodiment of the present invention.

While the elastic members 22 are kept in contact with the top edge of the sheet stack by the contact mechanism 23, and the elastic members 22 remain expanded by the expansion mechanism 24, the control unit 31 controls the air blow mechanism 26 to blow air into the spaces at the top edge of the sheet stack.

As the top edges of the paper sheets are separated from one another by the expansion mechanism 24, the air blow mechanism 26 can easily blow air into the spaces between the paper sheets. Thus, the effect to dehumidify the paper sheets P becomes greater, and separation performance in the sheet separation process is improved.

The control unit 31 then controls the conveyance belt 25 to suck the uppermost paper sheet P. Specifically, before controlling the conveyance belt 25 to suck the uppermost paper sheet P, the control unit 31 controls the contact mechanism 23 to bring the elastic members 22 into contact with the top edge of the sheet stack, controls the expansion mechanism 24 to expand the elastic members 22, and controls the air blow mechanism 26 to blow air into the spaces at the top edge of the sheet stack.

During a standby period before sheet feeding, the control unit 31 sequentially repeats the contact operation for the elastic members 22 with the contact mechanism 23, the expanding operation for the elastic members 22 with the expansion mechanism 24, and the air blowing operation with the air blow mechanism 26.

As described above, according to the first embodiment, spaces are formed between paper sheets as the elastic members 22 are expanded. As a result, the sheet drying efficiency (dehumidification performance) is increased, and the sticking force between the paper sheets is weakened. Thus, the influence of environmental disturbances can be reduced, and multiple feeding and non-feeding can be prevented.

Furthermore, as air is blown into the spaces at the top edge of the sheet stack, the sheet drying efficiency can be further increased, and the sticking force between the paper sheets can be further weakened.

After spaces are formed between the paper sheets, the uppermost paper sheet P of the sheet stack is sucked and conveyed. Thus, sheet feeding can be carried out, without multiple feeding and non-feeding.

Furthermore, as the elastic members 22 are disposed in positions facing the top edges of the paper sheets P in the direction of sheet conveyance in the sheet feed tray 21, the paper sheets P can be separated and then conveyed with high efficiency.

Furthermore, the control unit 31 sequentially repeats the contact operation for the elastic members 22 with the contact mechanism 23, the expanding operation for the elastic members 22 with the expansion mechanism 24, and the air blowing operation with the air blow mechanism 26. Thus, the paper sheets P can be more easily separated from one another.

Furthermore, as the rubber member 221 and the rubber members 222 of each elastic member 22 have different degrees of expansion and contraction, a difference can be generated between the force acting in the direction of contact with the paper sheets P and the force acting in the direction of expansion of the elastic members 22.

[First Modification]

Next, a first modification of the first embodiment will be described.

Figure 6A:
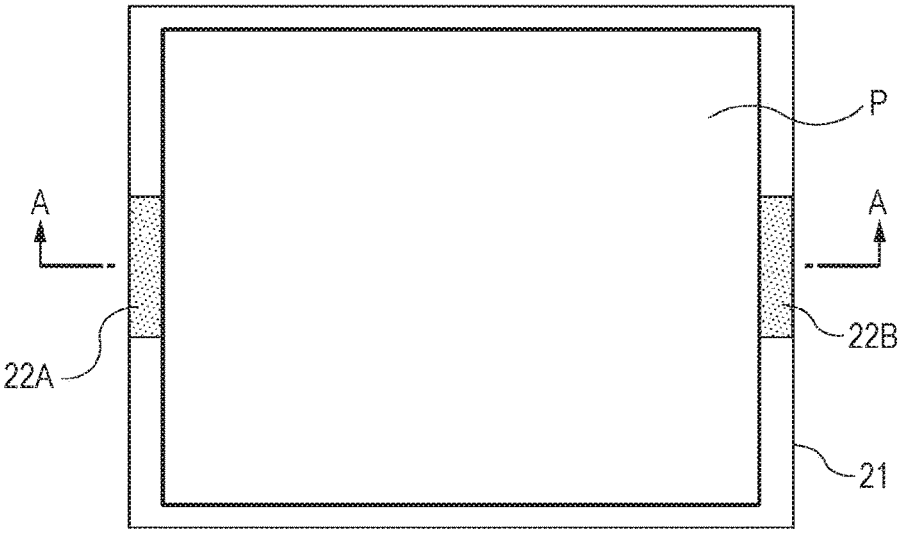
FIG. 6A is a diagram showing the arrangement of elastic members in an image forming apparatus according to a first modification of the first embodiment.

FIG. 6A shows the positions of elastic members 22A and 22B in an image forming apparatus of the first modification.

In the above described case of the first embodiment, the elastic members 22 are disposed in positions facing the top edges of the paper sheets in the direction of sheet conveyance in the sheet feed tray 21. In the first modification, on the other hand, the elastic member 22A is disposed in a position on the opposite side of the sheet feed tray 21 from the elastic member 22B. That is, paper sheets P are interposed between the elastic members 22A and 22B.

Figure 6B:
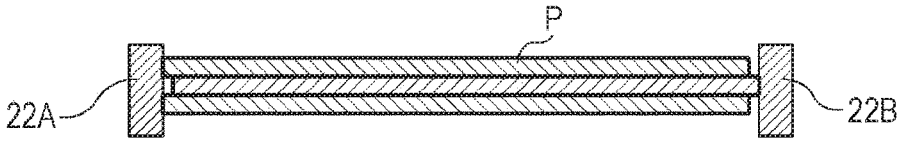
FIG. 6B is a cross-sectional view taken along the line A-A of FIG. 6A.

FIG. 6B is a cross-sectional view taken along the line A-A of FIG. 6A. Where the elastic members 22A and 22B are disposed in positions on the opposite sides from each other, if a paper sheet P is pulled toward one side (the side of the elastic member 22A, for example) of the sheet stack, the paper sheet P protrudes on the opposite side (the side of the elastic member 22B, for example). Therefore, in the first modification, the paper sheets P are firmly supported by the elastic members 22A and 22B located on the opposite sides from each other, and spaces can be formed between the paper sheets P. Thus, higher sheet separation performance can be achieved, compared with the sheet separation performance in a case where the surface with which one of the edges of the sheet stack comes into contact is a rigid surface.

[Second Modification]

Next, a second modification of the first embodiment will be described.

Figure 7:
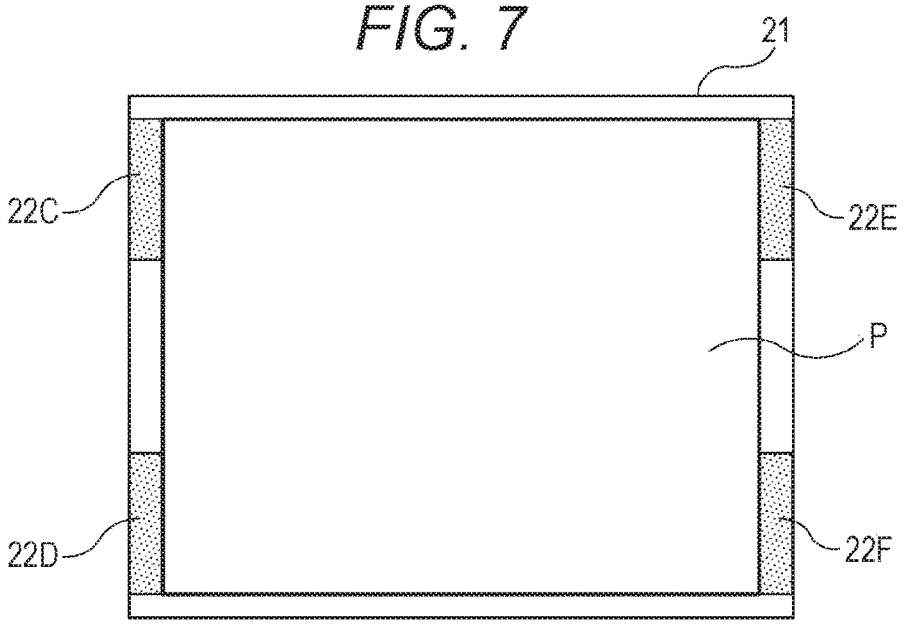
FIG. 7 is a diagram showing the arrangement of elastic members in an image forming apparatus according to a second modification of the first embodiment.

FIG. 7 shows the positions of elastic members in an image forming apparatus of the second modification.

In the second modification, elastic members 22C through 22F are arranged in the corner positions (at the four corners) of the paper sheets P stored in the sheet feed tray 21. Furthermore, the elastic member 22C and the elastic member 22E are located on the opposite sides from each other, and the elastic member 22D and the elastic member 22F are located on the opposite sides from each other.

According to the second modification, the elastic members 22C through 22F are disposed in the corner positions of the paper sheets P, to facilitate separation of the paper sheets P from one another.

In the example case of the second modification, the elastic members 22C through 22F are disposed in all the corner positions of the paper sheets P. However, elastic members may be provided in one or more of the corner positions of the paper sheets P.

Second Embodiment

Next, a second embodiment of the present invention will be described.

An image forming apparatus according to the second embodiment has substantially the same structure as that of the image forming apparatus 100 of the first embodiment. Therefore, like components are denoted by like reference numerals, and explanation of such components will not be made below. Instead, only the structures and processes characteristic of the second embodiment will be described below.

In the image forming apparatus of the second embodiment, the sheet feeding unit 20 includes a curvature adding member 27.

Figure 8A:
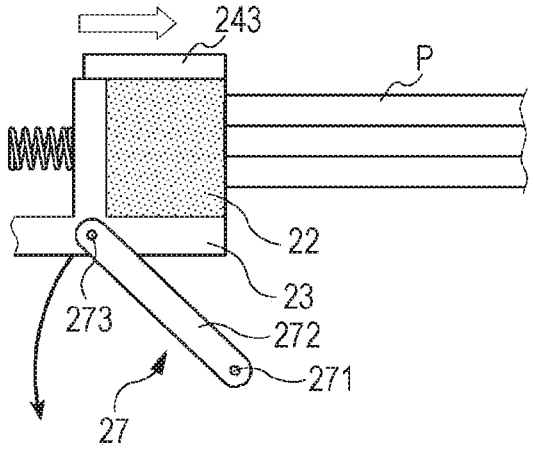
FIG. 8A is a diagram for explaining a curvature adding member of an image forming apparatus according to a second embodiment of the present invention.
Figure 8B:
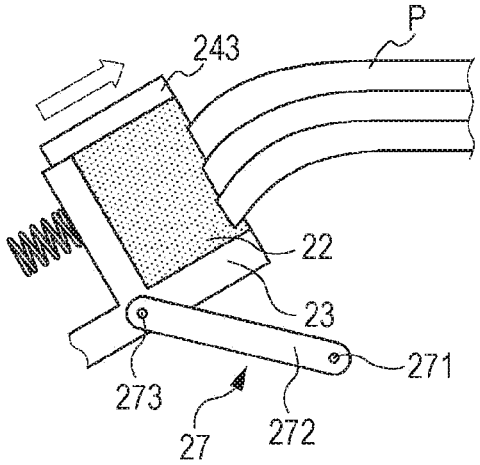
FIG. 8B is a diagram showing a situation where paper sheets are curved.
Figure 8C:
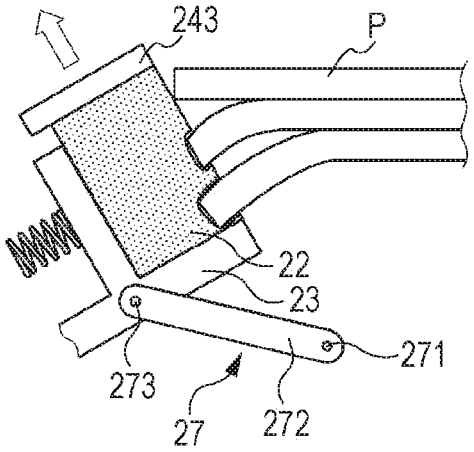
FIG. 8C is a diagram showing a situation where elastic members are expanded.

Referring now to FIGS. 8A through 8C, the curvature adding member 27 will be described.

The curvature adding member 27 bends the sheet stack so that the sheet stack protrudes on the side of the uppermost paper sheet of the sheet stack while the elastic members 22 are kept in contact with the top edge of the sheet stack by the contact mechanism 23. Specifically, the curvature adding member 27 includes a support point 271, an arm 272, and a support point 273. The curvature adding member 27 rotates the elastic members 22, the contact mechanism 23, and the expansion mechanism 24 integrally about the support point 271. As for the expansion mechanism 24, only the pull-up unit 243 is shown in FIGS. 8A through 8C.

FIG. 8A shows a situation where the elastic members 22 are brought into contact with the top edge of the sheet stack by the contact mechanism 23. In this situation, the control unit 31 controls the curvature adding member 27 to rotate the elastic members 22 about the support point 271. As a result, the paper sheets P protrude on the side of the uppermost paper sheet of the sheet stack, as shown in FIG. 8B. That is, the paper sheets P are provided with a curvature. Since the elastic members 22 are still kept in contact with the paper sheets P by the contact mechanism 23 at this point, the elastic members 22 do not move away from the top edges of the paper sheets P. The support point 273 is rotatably connected to the contact mechanism 23.

In this situation, the control unit 31 controls the expansion mechanism 24 to expand the elastic members 22. As a result, the paper sheets P separate from one another, and spaces are formed, as shown in FIG. 8C.

According to the second embodiment, spaces are easily formed between the paper sheets not only by the expansion of the elastic members 22 but also by the force (restoring force) of the paper sheets P recovering from the curved state to the original state. As a result, sheet separation performance is further improved. Thus, the influence of environmental disturbances can be reduced, and multiple feeding and non-feeding can be prevented.

Third Embodiment

Next, a third embodiment of the present invention will be described.

An image forming apparatus according to the third embodiment has substantially the same structure as that of the image forming apparatus 100 of the first embodiment. Therefore, like components are denoted by like reference numerals, and explanation of such components will not be made below. Instead, only the structures and processes characteristic of the third embodiment will be described below.

In the image forming apparatus of the third embodiment, the sheet feeding unit 20 includes elastic members 41, instead of the elastic members 22.

Figure 9:
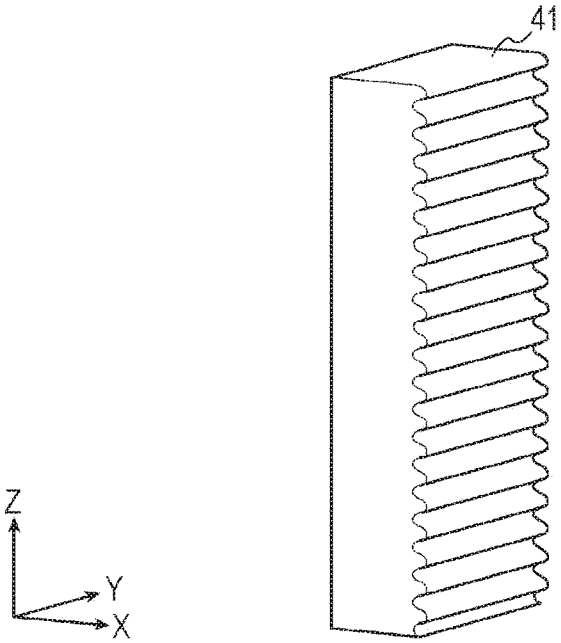
FIG. 9 is a perspective diagram showing the structure of an elastic member of an image forming apparatus according to a third embodiment of the present invention.

FIG. 9 shows the structure of each elastic member 41. The X-direction, the Y-direction, and the Z-direction shown in FIG. 9 correspond to those shown in FIG. 2A.

Each elastic member 41 is designed so that the surface to be brought into contact with the top edge of the sheet stack (the surface parallel to the Y-direction and the Z-direction) is corrugated in the X-direction.

According to the third embodiment, the influence of environmental disturbances can be reduced, and multiple feeding and non-feeding can be prevented, as in the first embodiment. Furthermore, as the contact surface of each elastic member 41 is a corrugated surface, the top edges of the paper sheets P can be easily caught by the elastic members 41 brought into contact with the paper sheets P, and thus, spaces can be easily formed between the paper sheets P.

Fourth Embodiment

Next, a fourth embodiment of the present invention will be described.

An image forming apparatus according to the fourth embodiment has substantially the same structure as that of the image forming apparatus 100 of the first embodiment. Therefore, like components are denoted by like reference numerals, and explanation of such components will not be made below. Instead, only the structures and processes characteristic of the fourth embodiment will be described below.

In the image forming apparatus of the fourth embodiment, the sheet feeding unit 20 includes elastic members 42, instead of the elastic members 22.

Figure 10A:
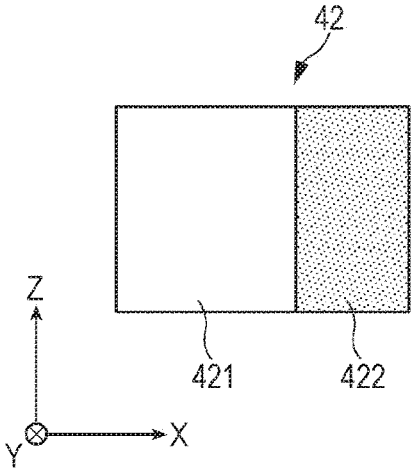
FIG. 10A is a cross-sectional view of an elastic member of an image forming apparatus according to a fourth embodiment of the present invention.

FIG. 10A shows the structure of each elastic member 42. The X-direction, the Y-direction, and the Z-direction shown in FIG. 10A correspond to those shown in FIG. 2A.

Each elastic member 42 includes a main portion 421 and a viscous element 422 attached to the surface of the main portion 421 to be brought into contact with the top edge of the sheet stack (the surface parallel to the Y-direction and the Z-direction).

Figure 10B:
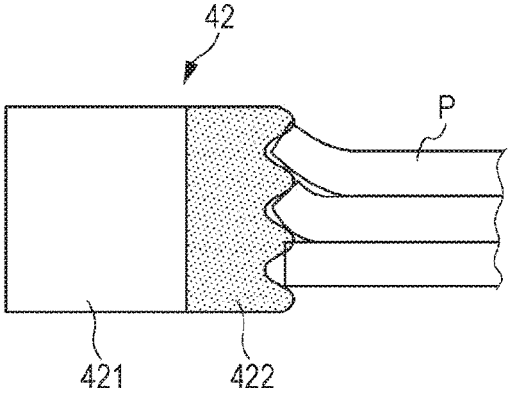
FIG. 10B is a diagram showing a situation where the elastic members are in contact with the top edge of a sheet stack.

As shown in FIG. 10B, when the elastic members 42 are brought into contact with the top edge of the sheet stack, the viscous element 422 is deformed to form spaces between the paper sheets and enter the spaces.

According to the fourth embodiment, the influence of environmental disturbances can be reduced, and multiple feeding and non-feeding can be prevented, as in the first embodiment. Furthermore, as each elastic member 42 includes the viscous element 422, the top edges of the paper sheets P can be easily caught by the elastic members 42 brought into contact with the paper sheets P, and thus, spaces can be easily formed between the paper sheets P.

Fifth Embodiment

Next, a fifth embodiment of the present invention will be described.

An image forming apparatus according to the fifth embodiment has substantially the same structure as that of the image forming apparatus 100 of the first embodiment. Therefore, like components are denoted by like reference numerals, and explanation of such components will not be made below. Instead, only the structures and processes characteristic of the fifth embodiment will be described below.

In the image forming apparatus of the fifth embodiment, the sheet feeding unit 20 includes an elastic member 43, an upper roller 44, a lower roller 45, and a cam member 46, instead of the elastic members 22 and the expansion mechanism 24.

Figure 11:
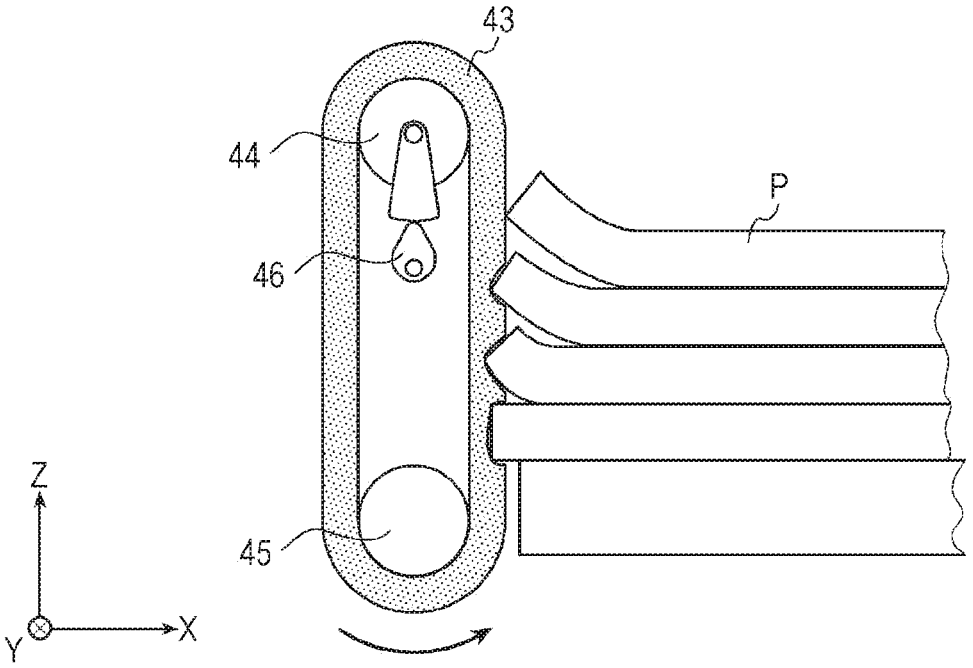
FIG. 11 is a diagram showing the structures of an elastic member, an upper roller, a lower roller, and a cam member of an image forming apparatus according to a fifth embodiment of the present invention.

FIG. 11 shows the structures of the elastic member 43, the upper roller 44, the lower roller 45, and the cam member 46. The X-direction, the Y-direction, and the Z-direction shown in FIG. 11 correspond to those shown in FIG. 2A.

The elastic member 43 is formed with an endless belt, and is stretched around the upper roller 44 and the lower roller 45. As the upper roller 44 and the lower roller 45 rotate, the elastic member 43 rotates.

Furthermore, as the cam member 46 rotates about a shaft, the shaft of the upper roller 44 moves up and down. In the fifth embodiment, the cam member 46 functions as the expansion mechanism.

The control unit 31 fixes the lower roller 45, and controls the cam member 46 to rotate, to move the shaft position of the upper roller 44 further away from the lower roller 45. In this manner, the elastic member 43 is expanded in the direction of stacking of the paper sheet P (the Z-direction).

As a result, spaces are formed between the paper sheets P at the top edges. FIG. 11 shows a situation where the elastic member 43 is expanded.

After the top edges of the paper sheets are separated from one another, the control unit 31 controls the upper roller 44 or the lower roller 45 to rotate, so that the paper sheets P can be conveyed toward the conveyance belt 25.

According to the fifth embodiment, the influence of environmental disturbances can be reduced, and multiple feeding and non-feeding can be prevented, as in the first embodiment. Furthermore, as the elastic member 43 formed with an endless belt is used, the paper sheets P can be conveyed upward while the paper sheets P are separated. Thus, conveyance performance is improved.

In the fifth embodiment, the shaft position of the upper roller 44 is moved further away from the lower roller 45 so that the elastic member 43 is expanded. However, the rotation of the lower roller 45 may be stopped, and only the upper roller 44 may be rotated. In this manner, the surface of the elastic member 43 in contact with the top edges of the paper sheets P can be expanded in the direction of stacking of the paper sheets P (Z-direction).

Sixth Embodiment

Next, a sixth embodiment of the present invention will be described.

An image forming apparatus according to the sixth embodiment has substantially the same structure as that of the image forming apparatus 100 of the first embodiment. Therefore, like components are denoted by like reference numerals, and explanation of such components will not be made below. Instead, only the structures and processes characteristic of the sixth embodiment will be described below.

In the image forming apparatus of the sixth embodiment, the sheet feeding unit 20 includes suction pads 51A, 51B, and 51C, instead of the conveyance belt 25.

Figure 12:
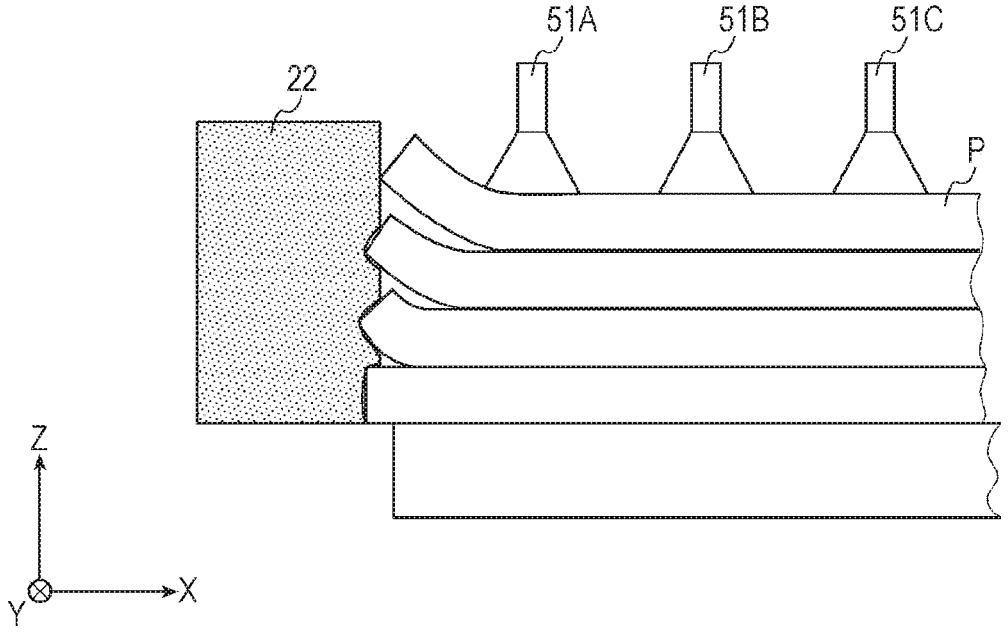
FIG. 12 is a diagram showing the arrangement of suction pads of an image forming apparatus according to a sixth embodiment of the present invention.
Figure 13:
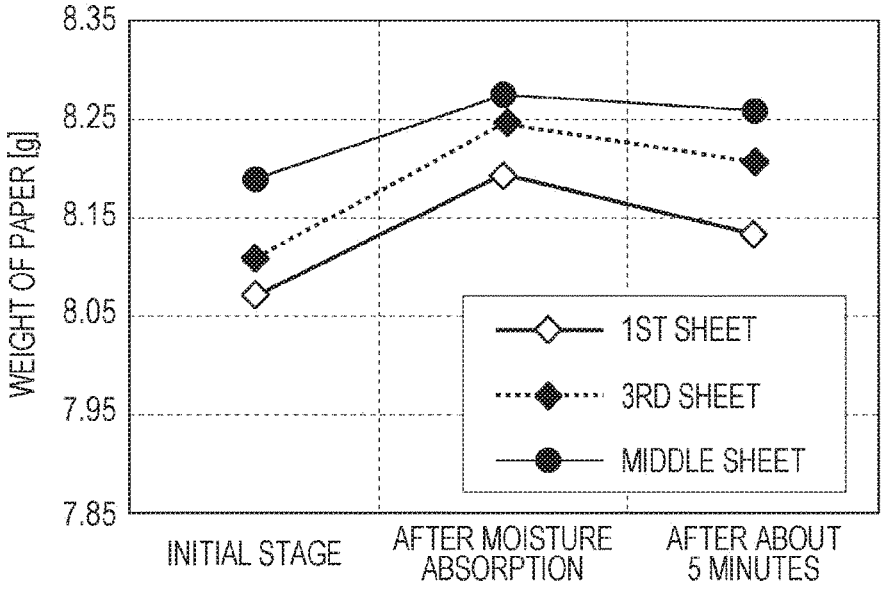
FIG. 13 is a graph showing changes in weight of paper in various environments.
Figure 14:
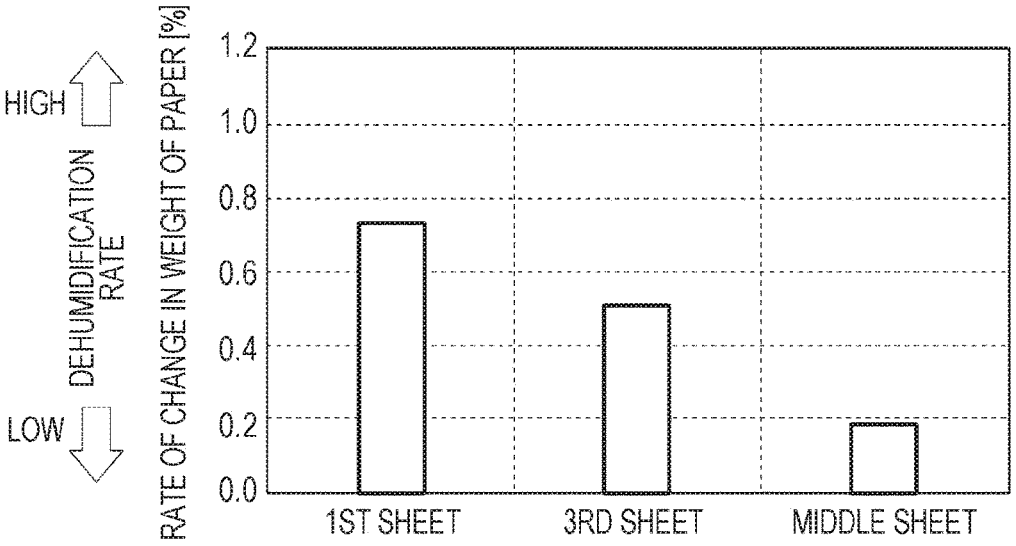
FIG. 14 is a graph showing rates of change in weight of paper in various positions in a sheet stack.

FIG. 12 shows an example of arrangement of the suction pads 51A, 51B, and 51C. The suction pads 51A, 51B, and 51C are designed to suck the uppermost paper sheet P, and are arranged in the X-direction in which the elastic members 22 are brought into contact with the paper sheets P. The suction pads 51A, 51B, and 51C can move in the Z-direction perpendicular to the sheet surfaces.

While the paper sheets P are separated from one another by the expansion of the elastic members 22, the control unit 31 controls the suction pads 51A, 51B, and 51C to suck the uppermost paper sheet P in the Z-direction, in the order of proximity to the top edge of the paper sheet P. As a result, the uppermost paper sheet P is lifted up, and is then conveyed.

According to the sixth embodiment, after spaces are formed between the paper sheets P, the suction pads 51A, 51B, and 51C suck the uppermost paper sheet P of the sheet stack, and then convey the uppermost paper sheet P. Thus, the influence of environmental disturbances can be reduced, and multiple feeding and non-feeding can be prevented.

The above descriptions of the respective embodiments are about examples of sheet feeder devices and image forming apparatuses according to embodiments of the present invention, and do not limit the present invention. Modifications may be made to the specific structures and the specific operations of the respective components of each device, without departing from the scope of the invention.

For example, the characteristic structures and operations of the above described embodiments may be combined in any appropriate manner.

Although the present invention has been described and illustrated in detail, it is clearly understood that the same is by way of illustrated and example only and is not to be taken byway of limitation, the scope of the present invention being interpreted by terms of the appended claims.

What is claimed is:

1. A sheet feeder device comprising:

a sheet feed tray configured to store a sheet stack formed with a plurality of paper sheets stacked in a stacking direction;

an elastic member capable of expanding and contracting, the elastic member having a length in the stacking direction;

a contact mechanism configured to bring the elastic member into contact with an edge of the sheet stack;

an expansion mechanism configured to expand the length of the elastic member in the stacking direction; and a control unit configured to cause the expansion mechanism to expand the length of the elastic member while the elastic member is kept in contact with the edge of the sheet stack by the contact mechanism.

2. The sheet feeder device according to claim 1, further comprising a suction conveyance unit configured to suck and convey the uppermost paper sheet of the sheet stack.

3. The sheet feeder device according to claim 2, further comprising an air blow mechanism configured to blow air against the sheet stack, wherein before causing the suction conveyance unit to suck the uppermost paper sheet, the control unit causes the contact mechanism to bring the elastic member into contact with the edge of the sheet stack, causes the expansion mechanism to expand the elastic member, and causes the air blow mechanism to blow air into a space at the edge of the sheet stack.

4. The sheet feeder device according to claim 1, further comprising an air blow mechanism configured to blow air against the sheet stack, wherein the control unit causes the air blow mechanism to blow air into a space at the edge of the sheet stack, while the elastic member is kept in contact with the edge of the sheet stack by the contact mechanism, and the elastic member remains expanded by the expansion mechanism.

5. The sheet feeder device according to claim 1, further comprising a curvature adding unit configured to bend the sheet stack and cause the sheet stack to protrude on the side of the uppermost paper sheet of the sheet stack while the elastic member is kept in contact with the edge of the sheet stack by the contact mechanism.

6. The sheet feeder device according to claim 1, wherein the elastic member is disposed in one of a position facing a top edge of the paper sheet in a direction of sheet conveyance in the sheet feed tray, and a corner position of the paper sheet.

7. The sheet feeder device according to claim 1, wherein the elastic member is one of a plurality of elastic members capable of expanding and contracting, and one of the elastic members is disposed in a position on the opposite side of the sheet feed tray from another one of the elastic members.

8. The sheet feeder device according to claim 1, wherein the elastic member is formed with a plurality of materials having different degrees of expansion and contraction from one another.

9. The sheet feeder device according to claim 1, wherein the surface of the elastic member to be brought into the edge of the sheet stack has one of a corrugated form and a viscous element attached thereto.

10. The sheet feeder device according to claim 1, wherein the elastic member is formed with a rotatable endless belt.

11. The sheet feeder device according to claim 1, wherein during a standby period before sheet feeding, the control unit repeats a contact operation for the elastic member with the contact mechanism, and an expanding operation for the elastic member with the expansion mechanism.

12. An image forming apparatus comprising the sheet feeder device according to claim 1.

13. The sheet feeder device according to claim 1, wherein the elastic member has a first end and a second end in a direction of the length and the expansion mechanism moves the first end and the second end relative to each other to expand the length of the elastic member.

* * * * *